US008181319B2

(12) United States Patent
Johnson et al.

(10) Patent No.: US 8,181,319 B2
(45) Date of Patent: May 22, 2012

(54) BUCKLE

(75) Inventors: Andrew P. Johnson, St. Paul, MN (US); Matthew J. Blackford, Hastings, MN (US)

(73) Assignee: D B Industries, Inc., Red Wing, MN (US)

( * ) Notice: Subject to any disclaimer, the term of this patent is extended or adjusted under 35 U.S.C. 154(b) by 254 days.

(21) Appl. No.: 12/414,364

(22) Filed: Mar. 30, 2009

(65) Prior Publication Data

US 2010/0243373 A1 Sep. 30, 2010

(51) Int. Cl.
*A44B 11/25* (2006.01)
*A44B 11/06* (2006.01)
*A62B 35/00* (2006.01)

(52) U.S. Cl. ..... 24/648; 24/170; 24/171; 24/634; 182/3

(58) Field of Classification Search ..... 24/170, 24/171, 648, 196, 634, 327, 337; 182/3
See application file for complete search history.

(56) References Cited

U.S. PATENT DOCUMENTS

| | | | | |
|---|---|---|---|---|
| 604,302 | A | 5/1898 | Clark | |
| 1,209,369 | A | 12/1916 | Wood | |
| 1,459,674 | A | 6/1923 | Jabner | |
| 2,518,889 | A | 8/1950 | Henderson | |
| 2,847,748 | A | 8/1958 | Robinton | |
| 2,903,774 | A * | 9/1959 | Harley | 24/170 |
| 3,090,092 | A | 5/1963 | Szemplak et al. | |
| 3,168,770 | A | 2/1965 | John, Jr. et al. | |
| 3,201,840 | A | 8/1965 | Jantzen | |
| 3,530,546 | A | 9/1970 | Ferrando | |
| 3,749,366 | A | 7/1973 | Brucker | |
| 3,757,744 | A | 9/1973 | Pravaz | |
| 3,789,467 | A | 2/1974 | Aratani et al. | |
| 4,091,508 | A * | 5/1978 | Yamada et al. | 24/171 |
| 4,101,171 | A | 7/1978 | Sasaki et al. | |
| 4,264,251 | A | 4/1981 | Blatt | |
| 4,307,494 | A | 12/1981 | Gasse et al. | |
| 4,321,734 | A | 3/1982 | Gandelman | |
| 4,534,087 | A | 8/1985 | Lau | |
| 4,553,633 | A | 11/1985 | Armstrong et al. | |
| 4,569,106 | A | 2/1986 | Lovato | |
| 4,587,695 | A | 5/1986 | Jensen | |
| 4,735,024 | A | 4/1988 | Rosato et al. | |
| 4,779,315 | A | 10/1988 | Kohus | |

(Continued)

FOREIGN PATENT DOCUMENTS

DE 3401978 A1 8/1985

(Continued)

OTHER PUBLICATIONS

Front assembled view of COBRA buckle (Art.Nr. FC45B) by AustriAlpin Vertriebs GmbH of Tyrol, Austria (2000).

(Continued)

*Primary Examiner* — Robert J Sandy
*Assistant Examiner* — Louis Mercado
(74) *Attorney, Agent, or Firm* — IPLM Group, P.A.

(57) ABSTRACT

A buckle and catch used to couple webbing together is provided. The buckle includes a connecting portion, a slide and locking member. The connecting portion is configured to selectively engage an engaging portion of a first webbing. The slide of the buckle is configured to engage a second webbing and the locking member is configured to selectively press the second webbing on the slide.

20 Claims, 7 Drawing Sheets

U.S. PATENT DOCUMENTS

| | | | | | |
|---|---|---|---|---|---|
| 4,916,779 | A | * | 4/1990 | Terada et al. | 24/593.1 |
| 5,033,171 | A | | 7/1991 | Kasai | |
| 5,156,506 | A | | 10/1992 | Bailey | |
| 5,203,058 | A | | 4/1993 | Krauss | |
| 5,203,829 | A | | 4/1993 | Fisk et al. | |
| 5,224,247 | A | | 7/1993 | Collier | |
| 5,277,348 | A | | 1/1994 | Reid | |
| 5,279,505 | A | | 1/1994 | Goudreau et al. | |
| 5,355,562 | A | * | 10/1994 | Matoba et al. | 24/625 |
| 5,419,020 | A | | 5/1995 | Murai | |
| 5,561,891 | A | | 10/1996 | Hsieh | |
| 5,649,341 | A | | 7/1997 | Ashline et al. | |
| 5,735,024 | A | | 4/1998 | Ortiz | |
| 5,857,247 | A | | 1/1999 | Warrick et al. | |
| 5,926,928 | A | | 7/1999 | Lundstedt | |
| 5,983,463 | A | * | 11/1999 | Prentkowski et al. | 24/196 |
| 6,230,370 | B1 | | 5/2001 | Nelsen | |
| 6,322,279 | B1 | | 11/2001 | Yamamoto et al. | |
| 6,405,685 | B1 | | 6/2002 | Cox | |
| 6,463,640 | B1 | * | 10/2002 | Toth | 24/648 |
| 6,484,372 | B2 | | 11/2002 | Novak et al. | |
| 6,622,350 | B2 | | 9/2003 | Austin et al. | |
| 6,641,116 | B1 | | 11/2003 | Huang | |
| 6,668,434 | B2 | | 12/2003 | Casebolt et al. | |
| 6,824,121 | B2 | | 11/2004 | Boice | |
| 6,871,517 | B2 | * | 3/2005 | Bonelli et al. | 70/58 |
| 6,965,231 | B1 | * | 11/2005 | Cinoglu et al. | 324/300 |
| 7,025,171 | B2 | | 4/2006 | Cox | |
| 7,036,628 | B2 | | 5/2006 | Wilcox et al. | |
| 7,069,623 | B2 | | 7/2006 | Lu | |
| 7,350,277 | B1 | | 4/2008 | Canfield et al. | |
| 7,353,573 | B2 | * | 4/2008 | Anscher | 24/625 |
| 7,373,701 | B2 | | 5/2008 | Coulombe et al. | |
| 7,513,018 | B2 | | 4/2009 | Koenig et al. | |
| 2006/0005293 | A1 | | 1/2006 | Frey et al. | |
| 2006/0048350 | A1 | | 3/2006 | Coulombe et al. | |
| 2006/0102423 | A1 | | 5/2006 | Lang et al. | |
| 2008/0060873 | A1 | | 3/2008 | Lang et al. | |
| 2008/0189921 | A1 | | 8/2008 | Tomosue | |

FOREIGN PATENT DOCUMENTS

| | | | |
|---|---|---|---|
| DE | 20 2004 017 043 | | 12/2004 |
| GB | 2189540 | A | 10/1987 |
| WO | WO 02/89626 | A2 | 11/2002 |

OTHER PUBLICATIONS

Front disassembeld view of COBRA buckle (Art. Nr. FC45B) by AustriAlpin Vertriebs GmbH of Tyrol, Austria (2000).
Back disassembeld view of COBRA buckle (Art. Nr. FC45B) by AustriAlpin Vertriebs GmbH of Tyrol, Austria (2000).
Front assembled view of buckle by International Safety Components Ltd. of Wales, U.K. (2000).
Front disassembled view of buckle by International Safety Components Ltd. of Wales, U.K. (2000).
Back disassembled view of buckle by International Safety Components Ltd. of Wales, U.K. (2000).
Front assembled view of Click Fix buckle (Art.Nr. 971501 & 971503) by Stubai GmbH of Tyrol, Austria (2000).
Front disassembled view of CLICK FIX buckle (Art.Nr. 971501 & 971503) by Stubai GmbH of Tyrol, Austria (2000).
Back disassembled view of CLICK FIX buckle (Art.Nr. 971501 & 971503) by Stubai GmbH of Tyrol, Austria (2000).
Front assembled view of Standard Click Lock buckle (Part Nos. 0383 & 0384) by Makefast Limited of Newtown, U.K. (2000).
Front disassembled view of Standard Click Lock buckle (Part Nos. 0383 & 0384) by Makefast Limited of Newtown, U.K. (2000).
Back disassembled view of Standard Click Lock buckle (Part Nos. 0383 & 0384) by Makefast Limited of Newtown, U.K. (2000).
Front assembled view of Fibula Velox buckle (Art. Code L22045) by Climbing Technology Limited of London, U.K. (2000).
Front disassembled view of Fibula Velox buckle (Art. Code L22045) by Climbing Technology Limited of London, U.K. (2000).
Back disassembled view of Fibula Velox buckle (Art. Code L22045) by Climbing Technology Limited of London, U.K. (2000).
Alpha Vertical, Studbai Brand STU971503 Click Fax Buckle anodised 13kN, [online], [retrieved Nov. 5, 2002], <http://www.alphavertical.co.za/HTML/stubai.html>.
AustriAlpin Stubaital—Paragliding—Buckles. Datasheet [online], Paragliding Buckles Cobra & Click Lock, [retrieved Nov. 5, 2002], <http://www.austrialpin.at/english/flug/k4.php>.
Climbing Technology Limited, Products\Security\Buckles\Fibula Velox, Datesheet [online], [retrieved Dec. 11, 2002], http://www.climbingtechnology.com/product/detail_security.asp?FAMIGLIA=Fibula_Velox . . .>.
Makefast.com, Datasheet [online], [retrieved Dec. 11, 2002]. <http://www.makefast.com/>.
Stuba Click Fix nicht verstellbar, [online], [retrieved Nov. 5, 2002],, http://www.stubai-bergsport.com/sites/produkte/produkt12/navigatpodukt.htm>.
International Search Report from Application Serial No. PCT/US2010/026287 mailed May 19, 2010.
Non-Final Office Action for U.S. Appl. No. 12/415,412 mailed Sep. 30, 2011.
Non-Final Office Action for U.S. Appl. No. 12/415,450 mailed Sep. 26, 2011.

* cited by examiner

BUCKLE

BACKGROUND

One method of coupling of two straps or webbings together is with the use of a buckle and catch arrangement. In this arrangement, a buckle coupled to a first webbing is designed to selectively retain the catch that is attached to a second webbing. The use of the buckle and catch arrangement to selectively couple webbings together is commonly used in safety harnesses such as fall protection harnesses. One common method of attaching an end of a webbing to a buckle is with the use of a knurl bar and a webbing retaining member. A knurl bar can more generally be referred to as a slide. Movement of a safety harness in use tends to loosen the webbing with this slide attaching arrangement. Hence, the webbing must be tightened periodically during use. The loosening and the required subsequent tightening of the webbing in the slide attaching arrangement are inconvenient and cause the webbing to wear. Reduction of wear on webbing of a fall protection harness is critical for the harnesses long term performance and proper fit to maximize safety.

For the reasons stated above and for other reasons stated below which will become apparent to those skilled in the art upon reading and understanding the present specification, there is a need in the art for a method of maintaining proper fit and reducing wear of webbing that is engaged with a slide of a buckle.

SUMMARY OF INVENTION

The above-mentioned problems of current systems are addressed by embodiments of the present invention and will be understood by reading and studying the following specification. The following summary is made by way of example and not by way of limitation. It is merely provided to aid the reader in understanding some of the aspects of the invention.

In one embodiment, a buckle is provided. The buckle includes a connecting portion, a slide and locking member. The connecting portion is configured to selectively engage an engaging portion of a first webbing. The slide of the buckle is configured to engage a second webbing and the locking member is configured to selectively press the second webbing on the slide.

BRIEF DESCRIPTION OF THE DRAWINGS

The present invention can be more easily understood and further advantages and uses thereof more readily apparent, when considered in view of the detailed description and the following figures in which.

In accordance with common practice, the various described features are not drawn to scale but are drawn to emphasize specific features relevant to the present invention. Reference characters denote like elements throughout Figures and text.

DETAILED DESCRIPTION

In the following detailed description, reference is made to the accompanying drawings, which form a part hereof, and in which is shown by way of illustration specific embodiments in which the inventions may be practiced. These embodiments are described in sufficient detail to enable those skilled in the art to practice the invention, and it is to be understood that other embodiments may be utilized and that mechanical changes may be made without departing from the spirit and scope of the present invention. The following detailed description is, therefore, not to be taken in a limiting sense, and the scope of the present invention is defined only by the claims and equivalents thereof.

Figure 1:
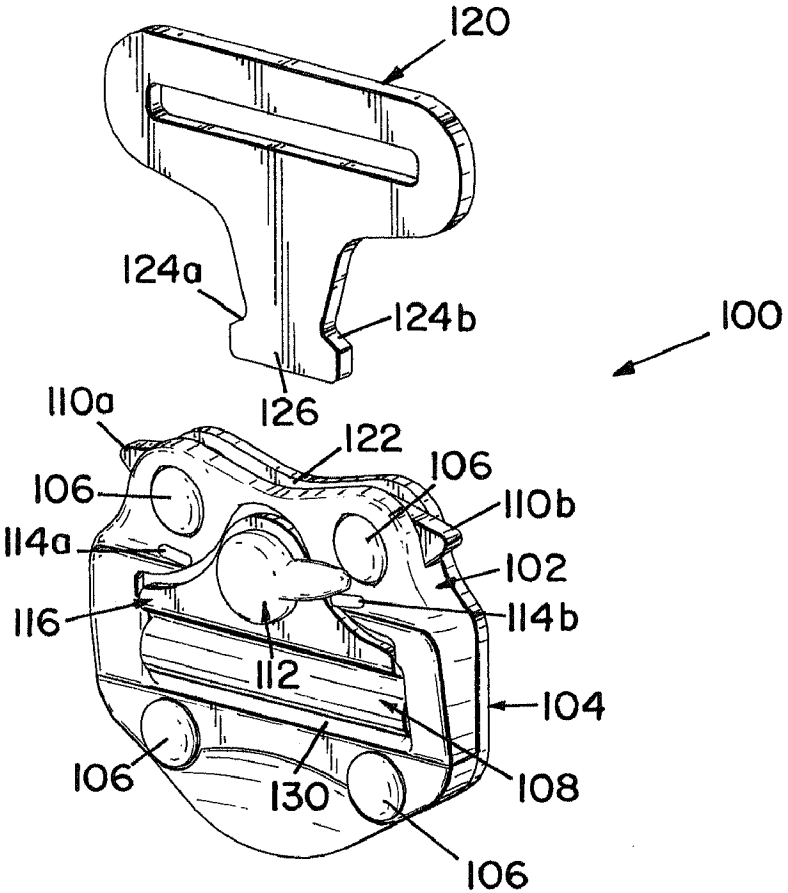
FIG. 1 is a front prospective view of a buckle and catch of one embodiment of the present invention.

Embodiments of the present invention provide a system of pressing a strap on a slide of a buckle to prevent the strap from loosing up. Referring to FIG. 1, a front assembled view of a buckle 100 of one embodiment is illustrated. As illustrated, the buckle 100 includes a first plate 102 and a second plate 104. The first plate 102 is coupled to the second plate 104 via rivets 106. A slide 108 is coupled between the first and second plates 102 and 104. Moreover, openings in the first and second plates, such as opening 130 of the first plate 102, allow for access of the slide 108. Sandwiched between the first plate 102 and the second plate 104 are pawls 110A and 110B that make up a connecting portion of the buckle 100. The pawls 110A and 110B engage shoulder portions 124A and 124B near an engaging end 126 of a catch 120 to lock the catch 120 in the buckle 100. In particular, the catch 120 (or engaging portion 120) becomes engaged when it is inserted in an opening 127 in the buckle 100 that is between the pawls 110A and 110B and the plates 102 and 104. The catch 120 can generally be referred to as the engaging portion 120. In embodiments, a cam knob 112 is used to move a locking plate 116 to selectively engage a strap 402 (shown in FIG. 4) on the slide 108. The cam knob 112 can be rotated between a locked and an unlocked position. The rotation of the cam knob 112 is contained within stops 114A and 114B. Operation and formation of the cam knob 112 is described below.

Figure 2:
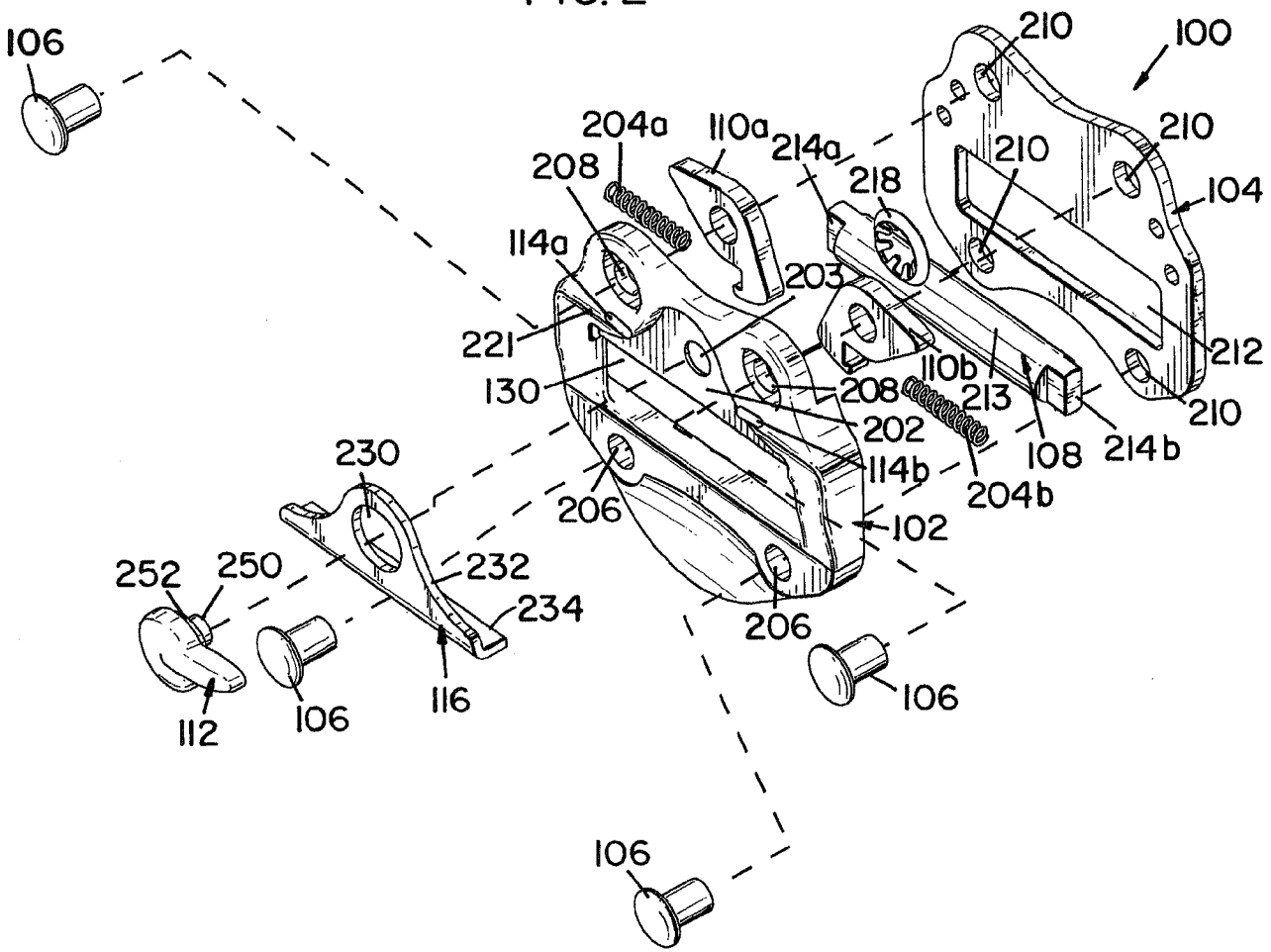
FIG. 2 is an exploded front perspective view of the buckle of FIG. 1.

In FIG. 2, an exploded front perspective view of the buckle 100 is illustrated. As illustrated, the first plate 102 includes opening 130 has discussed above. Opening 130 is rectangular in shape. The second plate 104 also includes a rectangular opening 212. The slide 108 has a cylindrical mid portion 213 around which a strap 402 (or webbing) (shown in FIG. 4) is engaged. The slide 108 further has a first end 214A and a second end 214B. As illustrated, the first end and the second end 214A and 214B each include flat surfaces that abut inner surfaces of the first 102 and second plates 104 when the first and second plates 102 and 104 are coupled together. This arraignment slidably retains the slide 108 in a within plates 102 and 104 of the buckle 100. The cylindrical mid portion 213 of the knur bar 108 is received in the openings 130 and 212 of the respective first and second plates 102 and 212. In one embodiment the surface of cylindrical mid portion 213 of the slide 108 has knurling (not shown) to increase friction.

The pawls 110A and 110B are pivotally coupled between the first plate 102 and the second plate 104 via rivets 106. Biasing members 204A and 204B bias the respective pawls 110A and 110B to a select pivot rotational position that engages catch 120 when the catch 120 is inserted in the opening 127 between the pawls 110A and 110B of the buckle 100. In the embodiment of FIG. 2, the locking member 116 is generally L-shaped having a first portion 232 and a second portion 234. The first portion 232 of the locking member 116 has a generally oval shaped passage 230. A first side 221 of the first plate 102 has a recess 202 shaped to receive the first portion 232 of the locking member 116. The second portion 234 of the locking member 116 fits in opening 130 of the first plate 102. The cam knob 112 includes an activation portion 252 and a retaining portion 250. The retaining portion 250 extends from the activation portion 252 of the cam knob 112 as illustrated. The first plate 102 of the buckle 100 includes a retaining aperture 203 that is in recess 202. The retaining portion 250 of the cam knob 112 extends through retaining aperture 203 of the first plate 102. A fastener 218 engages the retaining portion 250 of the cam knob 112 to retain the cam knob 112 in the buckle 100. Other types of fastener systems are contemplated, such as but not limited to, threadably engaging systems. The activation portion 252 of the cam knob 112 is received in the oval shaped passage 230 of the locking member 116. Rotation of the cam knob 112 causes the activation portion 252 (which is also generally oval in shape in one embodiment) to engage the generally oval shaped passage 230 of the locking member 116 to move the locking member 116 in relation to the first plate 102. Movement of the locking member 116 is further discussed below.

Figure 3:
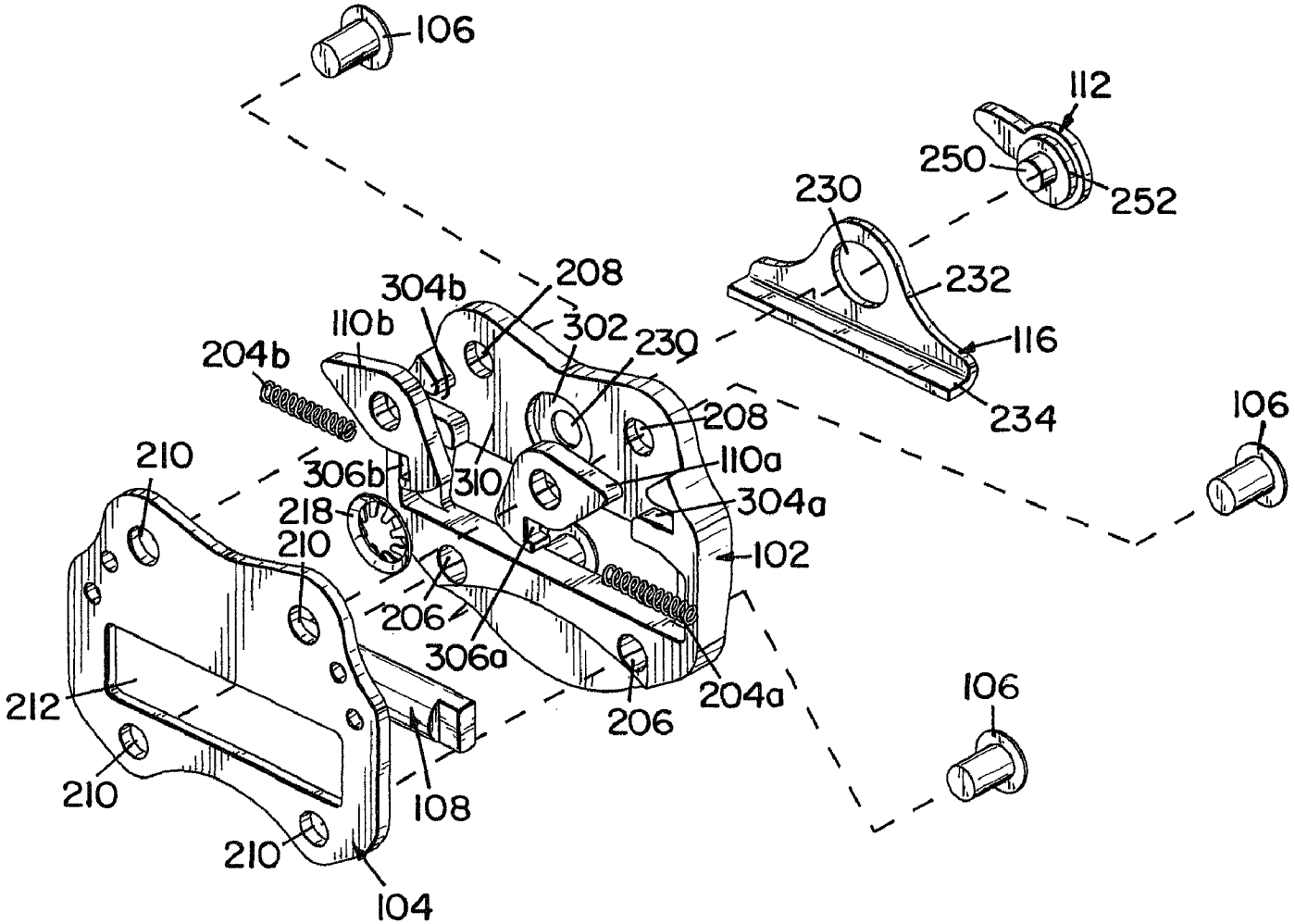
FIG. 3 is an exploded back perspective view of the buckle of FIG. 1.

FIG. 3 is an exploded back perspective view of buckle 100. This view further illustrates how the components come together to form buckle 100. For example, biasing member 204A is positioned between portion 306A of pawl 110A and recess 304A of the first plate 102. Similarly, biasing member 204B is positioned between portion 306B of pawl 110B and recess 304B of the first plate 102. The first pawl 110A and the second pawl 110B are both pivoted about a respective rivet 106 that is received in a respective aperture 208 of the first plate and a respective aperture 210 in the second plate 104. As discussed above, the biasing members 204A and 204B (which are springs in this embodiment) pivotally bias the respective pawls 110A and 110B to retain a catch, such as catch 120 of FIG. 1. As further illustrated in FIG. 3, the bottom portion of the first and second plates 102 and 104 are coupled together by rivets 106 passing through respective apertures 206 in the first plate 102 and respective apertures 210 in the second plate 104. This embodiment further includes a recess 302 in a second side 310 of the first plate 102 in which the retaining member 218 is received.

Figure 5:
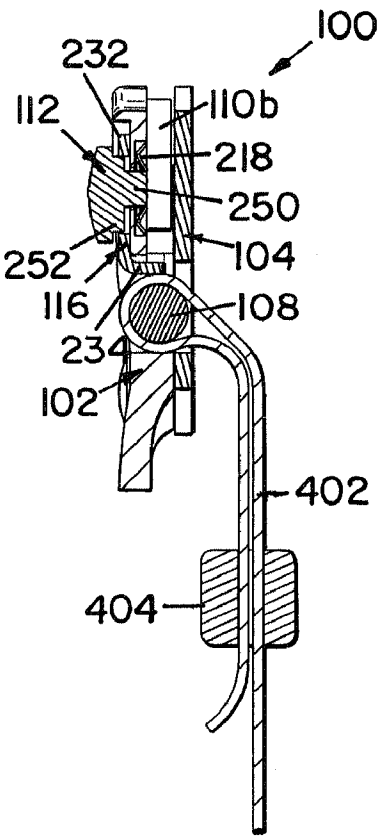
FIG. 5 is a side cross-sectional view of the buckle of FIG. 4.
Figure 4:
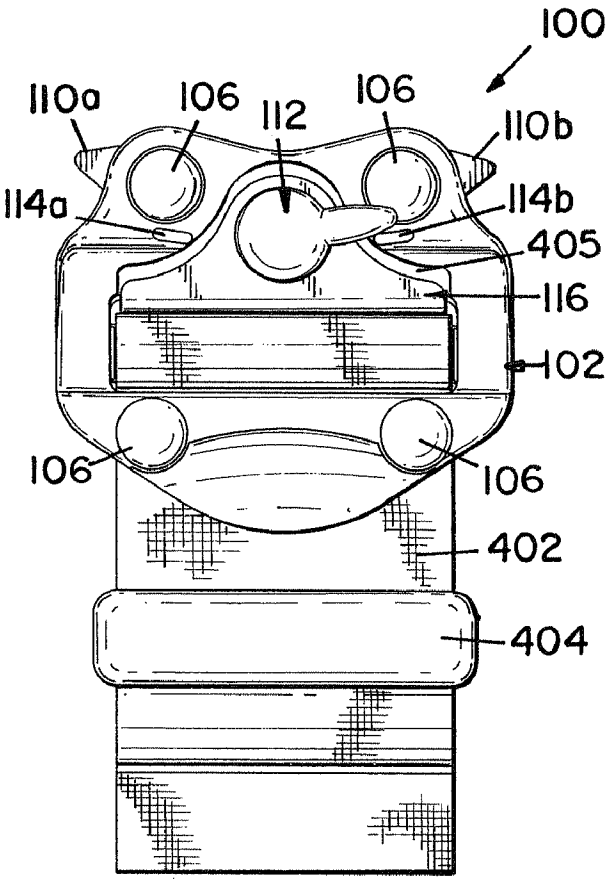
FIG. 4 is a front view of a buckle of FIG. 1 having a locking member engaged with a webbing on a slide of one embodiment.
Figure 7:
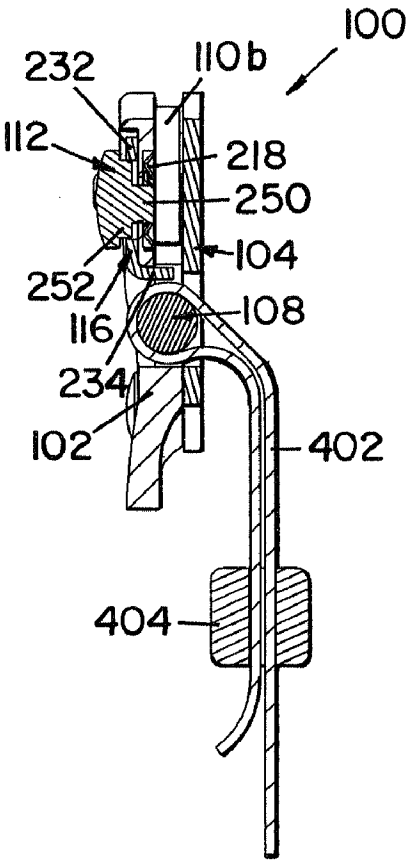
FIG. 7 is a side cross-sectional view of the buckle of FIG. 6.

Referring to FIG. 4, a front view of buckle 100 having a strap or webbing 402 coupled to the slide 214 is illustrated. FIG. 4 illustrates the locking member 116 in a locked position. As illustrated, in this embodiment the cam knob 112 is rotated to stop 114B on the first plate 102. This causes the locking member 116 to slide toward the webbing 402 on the slide 108. Gap 405 illustrates the locking plate 116 has been moved toward the slide 108. The locked position is further illustrated in the cross-sectional side view of the bracket 100 in FIG. 5. As illustrated, the second portion 234 of the locking plate 116 engages the webbing 402 on the slide 108 to prevent the webbing 402 from moving in the buckle 100. In particular, the engaged locking plate increases friction between the strap 402, the slide 108 and first plate 102 to reduce the possibility of the strap 402 moving relative to the slide 108 during use. Also illustrated in FIGS. 4 and 5 is webbing retaining member 404. The webbing retaining member 404 retains an end of the webbing 402 against itself and assists in keeping the webbing 402 around the slide 108 of the buckle 100. The engagement of the locking member 116 on the webbing 402 helps prevent the webbing 402 from loosening in relation to the slide 108 and the webbing retaining member 404.

Figure 6:
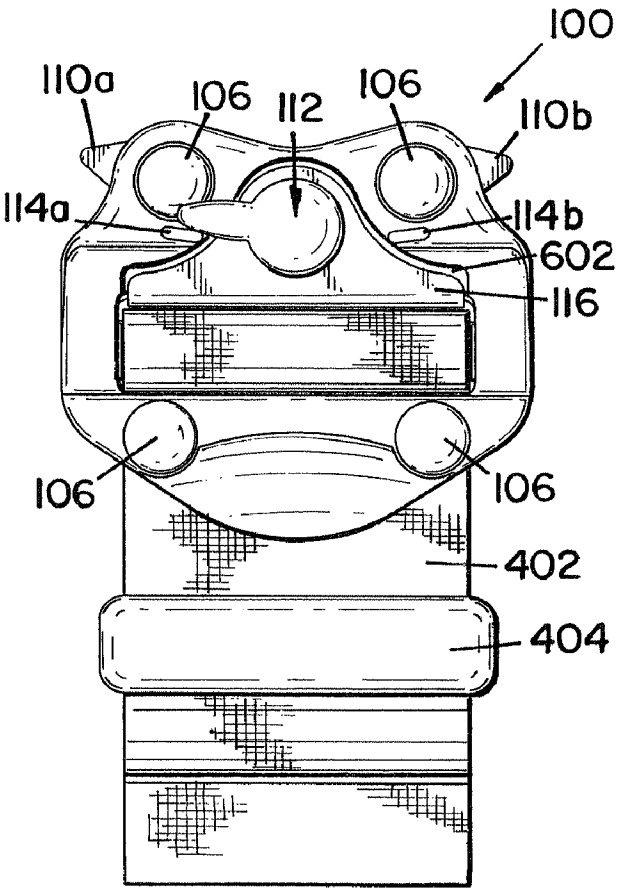
FIG. 6 is a front view of a buckle of FIG. 1 having the locking member not engaged with the webbing on the slide of one embodiment.

FIG. 6, illustrates the locking member 116 in an unlocked position. In this front view, buckle 100 has webbing 402 coupled to the slide 108. As illustrated, in this embodiment the cam knob 112 is rotated to stop 114A on the first plate 102. This causes the locking member 116 to move away from the webbing 402 on the slide 108. Gap 602 illustrates the locking plate 116 has been moved away from the slide 108 as compared to the gap 404 of FIG. 4. The unlocked position is further illustrated in the cross-sectional side view of the bracket 100 in FIG. 5. As illustrated, the second portion 234 of the locking plate 116 is not engaged with the webbing 402 on the slide 108.

Figure 8:
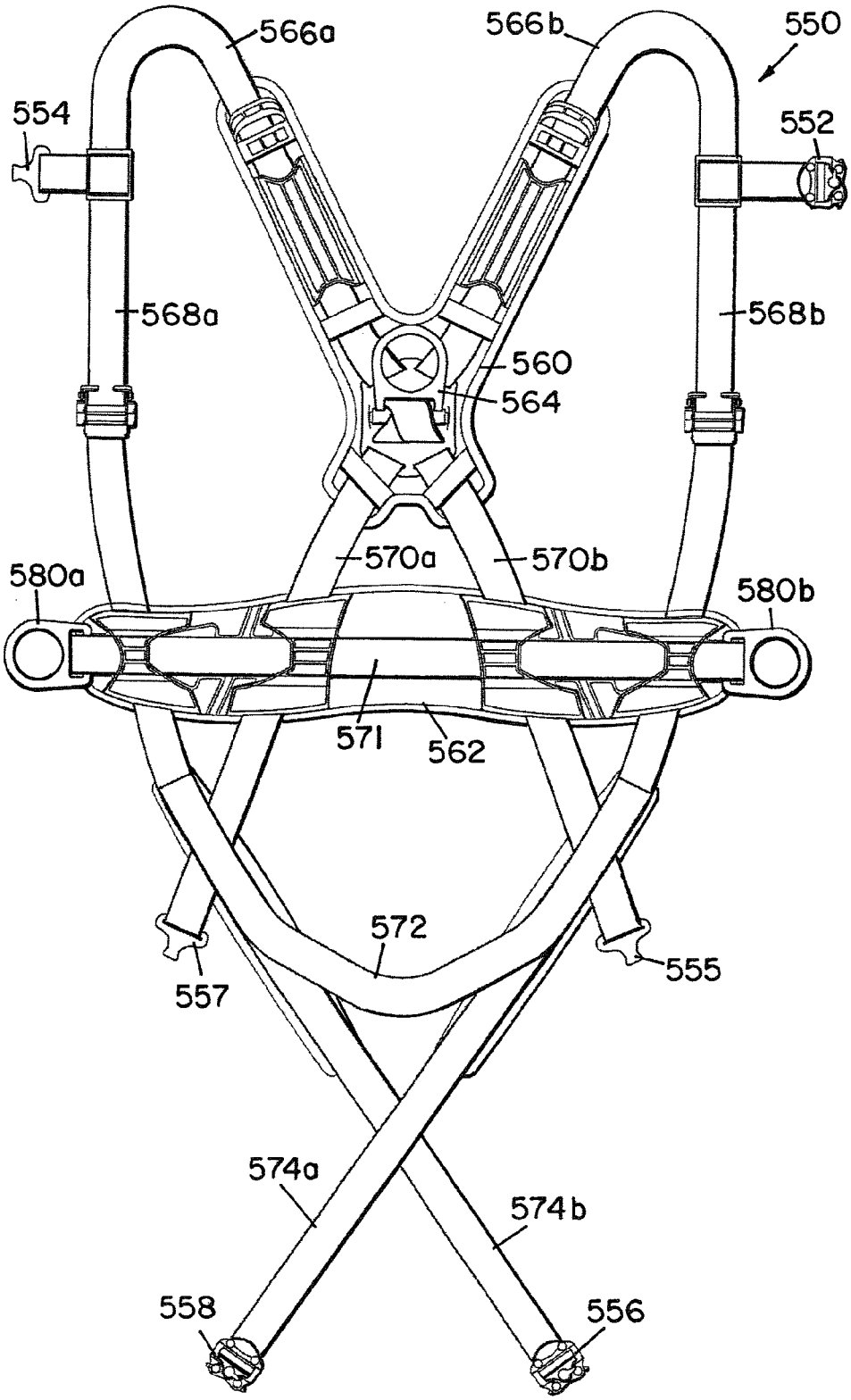
FIG. 8 is a rear view of a safety harness on one embodiment of the present invention.

FIG. 8 illustrates a rear view of a safety harness 550 of one embodiment of the present invention. As illustrated, the safety harness 550 includes a plurality of webbing (or straps) that are secured around a user. In particular, the webbing includes shoulder webbing 566A and 566B, front webbing 568A and 568B, back webbing 570A and 570B, seat webbing 572, hip webbing 571 and leg webbing 574A and 574B. In the embodiment of the FIG. 8, a single webbing forms webbing 568A, 566A and 570B and a single webbing forms 568B, 566B and 570A. Back pad 560 is positioned on the back of a user. A D-ring 564 is coupled to the back pad 560 and straps 570A and 570B. This D-ring 564 is used to couple the harness 550 to a support structure via a lanyard or lifeline. The hip webbing 571 retains the hip pad 562 around a user's hip. Attached to the hip webbing 571 are D-rings 580A and 580B used to position the user when in use. In embodiments, buckles such as buckle 100 described above are used to connect select webbings. In particular, buckle 552 is selectively coupled to catch 554 to attach the webbing across the chest of the user. Buckles 556 and 558 are coupled to respective catches 555 and 557 to strap the leg webbings 574A and 574B around legs of the user. Buckles 552, 556 and 558 include locking members and cam knobs such as locking member 116 and cam knob 112 discussed above to selectively lock respective webbing on slides, such as slide 108.

Figure 9:
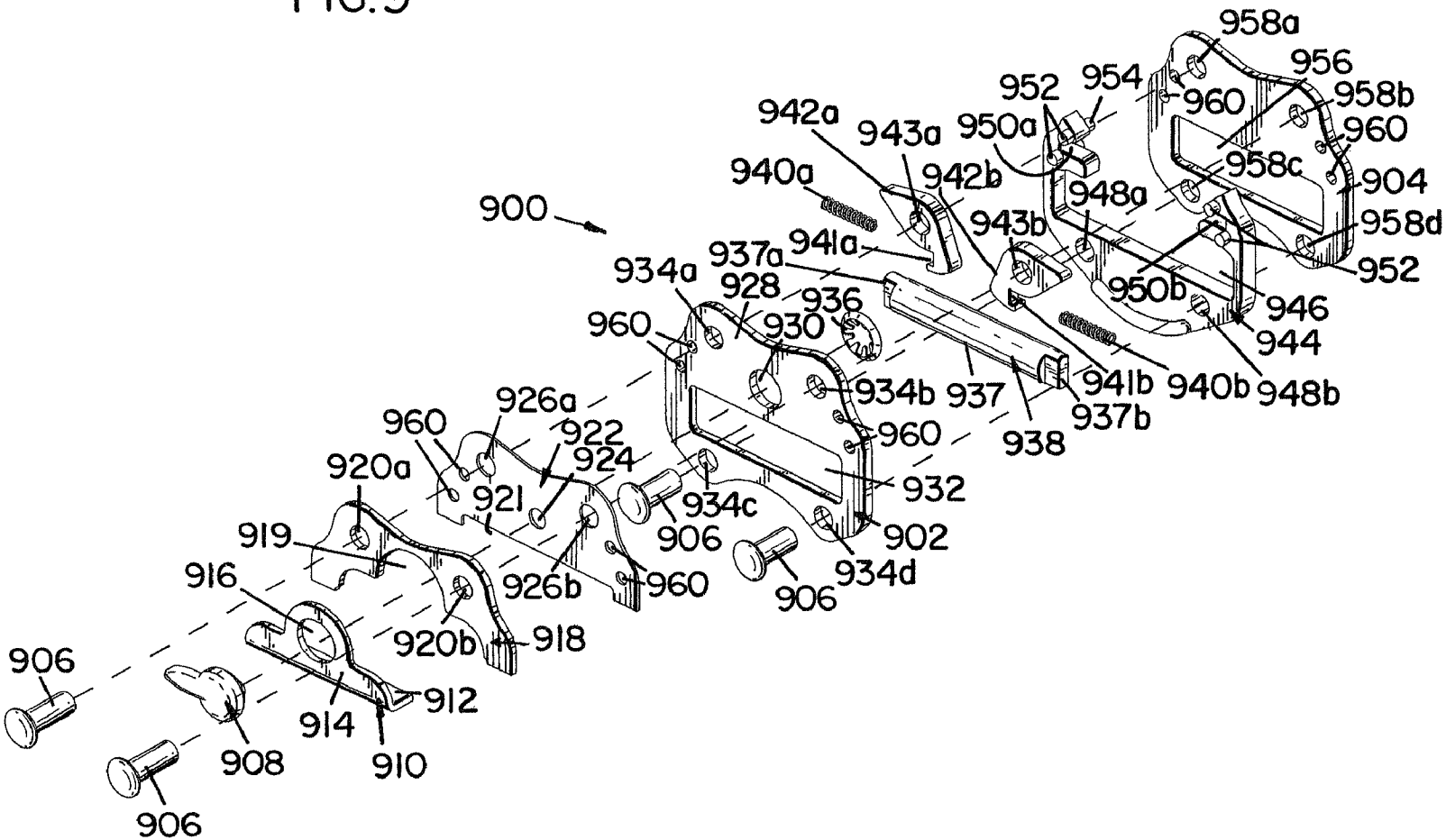
FIG. 9 is an exploded front perspective view of another embodiment of a buckle of the present invention.

Referring to FIG. 9 an exploded front perspective view of another embodiment of a buckle 900 is illustrated. This embodiment also includes a first plate 902 and a second plate 904. A slide 938 is positioned between the first plate 902 and the second plate 904. In particular, ends 937A and 137B having flat surfaces of the slide 938 are slidably contained between the first and second plates 902 and 904 while a mid portion 937 of the slide 938 is received in opening 932 of the first plate 902 and opening 956 of the second plate 904. In one embodiment, the slide includes a knurled surface. The embodiment of FIG. 9 further includes a mid plate 944 that is sandwiched between the first plate 902 and the second plate 904. The mid plate 944 includes a cutout section 946 to receive the slide 937. The mid plate 944 further includes alignment pins 954 that are received in alignment apertures 960 in the second plate and alignment pins 952 that are received in alignment apertures 960 in the first plate 902. Pawls 942A and 942B are pivotally coupled between the first and second plates via rivets 906. In particular, pawls 942A and 942B are pivotally coupled by rivets 906 passing through apertures 934A and 934B in the first plate 902, apertures 943A and 943B in pawls 942A and 942B respectively and apertures 958A and 958B in the second plate 904. Pawl 942A is biased by biasing member 940A. In particular, a first end of biasing member 940A engages surface 941A of pawl 942A and surface 950A of the mid plate 944. Pawl 942B is biased by biasing member 940B. In particular, a first end of biasing member 940B engages surface 941B of pawl 942B and surface 950B of the mid plate 944. The biasing members 940A and 940B bias the pawls 942A and 942B to engage a catch such as catch 120 of FIG. 1. The first plate 902, the mid plate 944 and the second plate 904 are further coupled together by rivets 906. In particular, a rivet 906 passing through aperture 934C of the first plate 902, aperture 948A of the mid plate 944 and aperture 958C of the second plate and a rivet 906 passing through aperture 934D of the first plate 902, aperture 948B of the mid plate 944 and aperture 958D of the second plate 904 couple a lower portion of the first plate 902, the mid plate 944 and the second plate 904 together.

The buckle 900 of FIG. 9 further includes a third plate 918 and a fourth plate 922. The fourth plate 922 is sandwiched between the third plate 918 and the first plate 902. The fourth plate 922 has alignment apertures 960 that receive alignment pins 952 of the mid plate 944. The third plate 918 and the fourth plate 922 are attached to the first plate 902 and the second plate 904 via rivets 906 passing through apertures 920A and 920B in the third plate 918 and apertures 926A and 926B in the fourth plate 922. The fourth plate 922 includes a cutout section 921 that is positioned around an upper portion of opening 932 of the first plate 902. This embodiment of the buckle 900 also includes a locking member 910. The locking member 910 is generally L-shaped having a first portion 914 and a second portion 912. The third plate 918 has a cutout section 919 that is in the shape of the first portion of 914 of the locking member 910. The first portion 914 of the locking member 910 is received in cutout section 919 of the third plate 918. The first portion 914 of the locking member 910 includes an oval shaped passage 916 that is aligned with aperture 924 in the fourth plate 922 and aperture 930 in the first plate 902. Cam knob 908 includes and activation portion, such as activation portion 252 illustrated in FIG. 3 that is generally oval in shape. The activation portion 252 is received in the oval shape passage 916 in the first portion 914 of the locking mechanism 910. Cam knob 908 further includes a retaining portion, such as retaining portion 250 of FIG. 3 that extends from the activation portion 252. The retaining portion 250 of cam knob 908 is received through aperture 924 of the fourth plate 922 and aperture 930 of the first plate 902. A fastener 936 is attached to the retaining portion 250 of cam knob 908 to retain activation portion 352 of the cam knob 908 in the oval shaped passage 916 of the locking member 910.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

The invention claimed is:

1. A buckle comprising:

a connecting portion configured to selectively engage an engaging portion of a first webbing;

a slide configured to engage a second webbing;

a locking member configured to selectively press the second webbing on the slide, the locking member having generally an oval passage; and a cam knob having generally an oval portion configured and arranged to be received in the oval passage of the locking member, wherein rotation of the cam knob rotates the oval portion in the oval passage of the locking member thereby causing the locking member to selectively press the second webbing on the slide.

2. The buckle of claim 1, wherein the engaging portion of the first webbing is a catch, the connection portion of the buckle further comprising:

a first pawl; and a second pawl, the first and second pawls configured to selectively engage a shoulder portion of the catch.

3. The buckle of claim 2, further comprising:

a first plate; and a second plate, coupled to the first plate, the first and second pawl sandwiched between the first and second plates, the first and second pawls further pivotally coupled to the first and second plates.

4. The buckle of claim 3, wherein the first plate has a first opening and the second plate has a second opening, a mid portion of the slide is accessible through the first and second openings.

5. The buckle of claim 4, wherein the locking member has a first portion and a second portion, the first portion and the second portion being in a L-shaped configuration.

6. The buckle of claim 5, wherein the second portion of the locking member is received in the first opening in the first plate.

7. The buckle of claim 6, further comprising:

the first portion of the locking member having the generally oval passage; and the generally oval activation portion of the cam knob received in the oval passage of the first portion of the locking member, wherein rotation of the cam knob rotates the generally oval activation portion in the oval passage of the first portion of the locking member thereby causing movement of the locking member.

8. The buckle of claim 7, further comprising:

the first plate having a connecting aperture;

the cam knob further having a connecting portion extending from the generally oval activation portion, the connecting portion extending through the connecting aperture of the first plate; and a fastener coupled to the connection portion of the cam knob to pivotally couple the cam knob to the first plate.

9. A coupling system comprising:

a first plate having a first opening;

a second plate having a second opening, the first plate being coupled to the second plate;

a slide coupled between the first and second plates such that a mid portion of the slide is positioned in the first opening of the first plate and the second opening of the second plate, the mid portion of the slide configured to engage a webbing;

a locking member being slideably engaged with the first plate, the locking member configured to selectively engage the webbing on the mid portion of the slide to selectively secure the webbing to the slide the locking member having a generally oval passage; and a cam knob having generally an oval portion configured and arranged to be received in the oval passage of the locking member, wherein rotation of the cam knob rotates the oval portion in the oval passage of the locking member thereby causing the locking member to selectively press the second webbing on the slide.

10. The coupling system of claim 9, wherein the locking member is L-shaped having a first portion and a second portion, the first portion slideably engaged with the first plate, the second portion received in the first opening of the first plate, the second portion of the locking member further selectively engaging the webbing on the mid portion of the slide, the first portion of the locking member having the generally oval passage.

11. The coupling system of claim 10, wherein rotation of the cam knob rotates the generally oval portion in the oval passage of the first portion of the locking member thereby causing the locking member to slideably move in relation to the first plate.

12. The coupling system of claim 11, wherein the cam knob further has a connecting portion extending from the generally oval portion, the connecting portion of the cam knob extending through a connection aperture in the first plate; and a fastener coupled to the connection portion of the cam knob to pivotally couple the cam knob to the first plate.

13. The coupling system of claim 9, further comprising:

a catch, the catch having a shoulder section; and at least one pawl pivotally coupled between the first and second plates, the at least one pawl configured to selectively retain the catch within the first and second plates by engaging the shoulder section of the catch.

14. The coupling system of claim 13, further comprising:

at least one biasing member, the at least one biasing member positioned between the at least one pawl and a portion of the first plate to bias the at least one pawl to retain the catch.

15. A safety harness comprising:

webbing configured to engage portions of a user's body; and at least one buckle system configured to connect select webbing together to secure the user in the harness, the at least one buckle system including, a catch, the catch having a shoulder section, the catch coupled to an associated first webbing, and a buckle the buckle including, a first plate having a first opening;

a second plate having a second opening, the first plate being coupled to the second plate, a slide coupled between the first and second plates such that a mid portion of the slide is positioned in the first opening of the first plate and the second opening of the second plate, the mid portion of the slide configured to engage an associated second webbing, a locking member being slideably engaged with the first plate, the locking member configured to selectively engage the associated second webbing on the mid portion of the of slide the locking member having generally oval passage; and a cam knob having generally an oval portion configured and arranged to be received in the oval passage of the locking member, wherein rotation of the cam knob rotates the oval portion in the oval passage of the locking member thereby causing the locking member to selectively press the second webbing on the slide.

16. The safety harness of claim 15, wherein the buckle of the at least one harness system further comprises:

at least one pawl pivotally coupled between the first and second plates, the at least one pawl configured to selectively retain the catch within the first and second plates by engaging a shoulder section of the catch.

17. The safety harness of claim 16, further comprising:

at least one biasing member, the at least one biasing member positioned between the at least one pawl and a portion of the first plate to bias each pawl to retain the catch.

18. The safety harness of claim 15, wherein the locking member is L-shaped having a first portion and a second portion, the first portion slidably engaged with the first plate, the second portion received in the first opening of the first plate, the second portion further selectively engaging the associated second webbing on the mid portion of the slide.

19. The safety harness of claim 18, further comprising:

the first portion of the locking member having generally an oval passage, wherein rotation of the cam knob rotates the oval portion in the oval passage of the first portion of the locking member thereby causing the locking member to move in relation to the first plate.

20. The safety harness of claim 19, wherein the cam knob further has a connecting portion extending from the oval portion, the connecting portion of the cam knob extending through a connection aperture in the first plate; and a fastener coupled to the connection portion of the cam knob to pivotally couple the cam knob to the first plate.

* * * * *